US006280367B1

(12) United States Patent
Arsenault

(10) Patent No.: US 6,280,367 B1
(45) Date of Patent: Aug. 28, 2001

(54) BALL RETURN APPARATUS FOR EXERCISING ABDOMINAL MUSCLES

(76) Inventor: Christopher Arsenault, P.O. Box 1724, Port Washington, NY (US) 11050

( * ) Notice: Subject to any disclaimer, the term of this patent is extended or adjusted under 35 U.S.C. 154(b) by 0 days.

(21) Appl. No.: 09/528,931

(22) Filed: Mar. 20, 2000

Related U.S. Application Data

(60) Provisional application No. 60/150,851, filed on Aug. 26, 1999.

(51) Int. Cl.[7] ..... A63B 26/01

(52) U.S. Cl. ..... 482/140; 482/77; 482/26; 482/27; 473/197; 473/422

(58) Field of Search ..... 482/142, 26–32, 482/77, 35; 434/248, 251; 473/447, 479, 197, 422; 472/93–94, 137; 5/449; 446/220.1; 441/40

(56) References Cited

U.S. PATENT DOCUMENTS 4,478,420 * 10/1984 Sowards ..... 473/435

5,042,813 * 8/1991 Huang ..... 473/153

* cited by examiner

*Primary Examiner*—Jerome W. Donnelly
*Assistant Examiner*—Lori Baker Amerson
(74) *Attorney, Agent, or Firm*—Michael I. Kroll

(57) ABSTRACT

The present invention 10 discloses an exercise device wherein a user 12 exercises the abdominal muscles by throwing a ball 14 against a net system 20, 40, 42. The user 12 places his head 34 and back 32 on a pivotable platform 18 and his buttocks 30 and feet 56 on a stationary platfoin 22 which pivots about spring 36. The spring 36 provides lift assistance when the user 12 throws the ball 14 and shock dissipation when the user 12 catches the ball 14. Foot straps 28 are provided for securing the feet 26 of the user 12. The nets 20, 40, 42 are mounted on supports 48, 50 which are vertically adjustable using locking means 52. Nets 40, 42 also have pivot means 46 for folding for storage against central net 20.

20 Claims, 10 Drawing Sheets

BALL RETURN APPARATUS FOR EXERCISING ABDOMINAL MUSCLES

This application is subject to U.S. provisional application serial no. 60/150,851, filed Aug. 26, 1999 and please incorporate by reference all information is referenced provisional application into this instant application.

BACKGROUND OF THE INVENTION

1. Field of the Invention

The present invention relates generally to exercise devices and, more specifically, to a ball return apparatus with a pivoting bi-sectional spring-loaded base platform to help propel the user from a reclined position to a sitting position as he throws a weighted ball towards an elevated ball deflection net that is connected to the stationary portion of the base platform by means of a releasable high-tension mechanical stabilizing spring. A similar spring connects the stationary and pivoting portions of the base platform to provide lift when the user is on the upswing and shock dissipation when reclining. The present invention incorporates skill and gamesmanship into abdominal exercises so as to provide a fun and interesting way for the user to get a complete abdominal workout.

Use of the present invention requires the user to lay on his back upon the base platform with his feet secured within foot straps located in the proximity of the deflection net. The user's feet and buttocks reside on the stationary portion of the base platform while his back and head are supported by the pivoting backrest which is at approximately a 45 degree angle to the floor and stationary portion. The user begins the exercise by holding a ball and leaning back against the pivoting backrest to provide tension on the spring mechanism so he is propelled forward when he begins the sit-up. As the user is moving upward he throws the ball towards one of the deflection nets depending on which abdominal muscle group is selected to be worked. The user tries to time the throw so that the rebounding ball could be caught as he is heading back down to the reclined position where the tension spring provides resistance to dissipate impact and then reverses momentum to provide upward impetus for the next throw.

The deflection nets are maintained by a framework that is connected to two vertical support members. Each support member comprises a cylindrical tube that telescopes into a cylindrical tube of a larger diameter with both tubes having matching apertures to receive a lockout or pin to secure it into place and adjust the height of the deflection nets. The inferior ends of the support members are attached to the base platform via a high tension mechanical stabilizing spring that will prevent erratic movement of the deflection nets when impacted by the ball.

2. Description of the Prior Art

There are other ball return devices designed for returning balls while exercising. Typical of these is U.S. Pat. No. 5,039,109 issued to Kenneth J. Mahoney et al. on Aug. 13, 1991.

Another patent was issued to Andrew Caruso on Feb. 15, 1994 as U.S. Pat. No. 5,286,020. Yet another U.S. Pat. No. 5,580,048 was issued to Kerry D. Mullen et al. on Dec. 3, 1996. Another was issued on Mar. 25, 1997 to Hua-Lu Hsiang as U.S. Pat. No. 5,613,922 and still yet another was issued to Ronald A. Anderson et al. on Jun. 30, 1998 as U.S. Pat. No. 5,772,537.

U.S. Pat. No. 5,039,109

Inventor: Kenneth J. Mahoney et al.

Issued: Aug. 13, 1991

The portable mounting stand apparatus of this invention is adapted to receive a ball return apparatus for the like thereon and provide means for ease of movement from a portable transport condition to a rigid usage condition. The portable mounting stand apparatus includes a main support base assembly; a forward base support assembly secured to a forward portion of the main support base assembly; and a rearward base support assembly connected to a rear portion of the main support base assembly. The forward and rearward base support assemblies are each provided with support wheel assemblies to contact a support surface for ease of mobility in the transport position. The rearward base includes a pivotal stationary support assembly having a pivotable stand assembly which is selectively actuated to move support leg assemblies into and out of contact with the support surface. When in the rigid usage condition, the pivotable stationary support assembly acts to elevate the rearward support wheel assemblies out of contact with the support surface so as to present a rigid nonmoving structure for the use of the ball return apparatus, for example, on a basketball court in a basketball practice drill session.

U.S. Pat. No. 5,286,020

Inventor: Andrew Caruso

Issued: Feb. 15, 1994

A medicine ball construction includes a pliable cover of leather with an inflatable rubber bladder within said cover., the bladder wall being thick and the bladder being inflated to a low pressure so that the ball is pliable and light.

U.S. Pat. No. 5,580,048

Inventor: Kerry D. Mullen et al.

Issued: Dec. 3, 1996

A modular return apparatus for reflecting back an object such as a ball or a puck when struck by the ball or puck traveling on a playing surface, for use in returning the ball or puck to the player for another shot and in training the player to shoot the ball or puck accurately and anticipate the anode of reflection and velocity of the puck or ball comprises an elongated reflecting bumper a pair of supports for the reflecting bumper, and a rod for connecting the supports to each other and preventing their relative motion. A net may be attached to the return apparatus to catch the puck.

U.S. Pat. No. 5,613,922

Inventor: Hua-Lu Hsiang

Issued: Mar. 25, 1997

A multipurpose athletic training apparatus including a trampoline, two fastening devices for fastening the trampoline to the stands, the fastening devices being adjustable to fix the trampoline to between a horizontal position in which the trampoline is used as a table, and a tilted position in which the trampoline is used as a rebound apparatus for rebounding balls thrown against it, a handrail for fastening to the stands at the top, and two net posts for fastening to the stands for stretching the net for the game of badminton.

U.S. Pat. No. 5,772,537

Inventor: Ronald A. Anderson et al.

Issued: Jun. 30, 1998

A ball return device that enables a user to quickly and easily adjust the force with which a ball thrown into the device is returned. The ball return device includes a frame constructed from sections of plastic tubing joined by 90-degree elbows, forming a base and an elevatable portion. The elevatable portion of the frame is pivotally mounted to the base and adjustably positioned at a desired angle relative to the generally horizontal base by a pair of support members. The angle of the elevatable portion of the frame to the base determines the direction in which the ball is returned relative to a given incident path. The support members extend between the base and the elevatable portion of the frame, and each includes a smaller diameter tube slidably fitted into a larger diameter tube and selectively fixed at one of a plurality of preset lengths by a pin that passes through orifices formed in the two tubes. In one preferred form of the invention. a net having hexagonal openings is suspended within the elevatable portion of the frame by lengths of an elastomeric cord that connect a periphery of the net to the frame. The hexagonal openings deform around a ball impacting the net in such a way as to ensure that the ball is consistently returned at a predictable angle relative to the angle at which the ball impacts the net. The elastomeric cord can be tightened or loosened to adjust the tension of the net, thereby determining the relative force with which a ball impacting the net is returned. A friction clip attached to the elastomeric cord retains the selected tension.

While these ball return devices may be suitable for the purposes for which they were designed, they would not be as suitable for the purposes of the present invention, as hereinafter described.

SUMMARY OF THE PRESENT INVENTION

The present invention discloses an exercise device wherein a user exercises the abdominal muscles by throwing a ball against a net system. The user places his head and back on a pivotable platform and his buttocks and feet on a stationary platform which pivots about spring. The spring provides lift assistance when the user throws the ball and shock dissipation when the user catches the ball. Foot straps are provided for securing the feet of the user. The nets are mounted on supports which are vertically adjustable using locking means. Nets also have pivot means for folding for storage against central net.

A primary object of the present invention is to provide a ball return apparatus for exercising abdominal muscles and improving timing and coordination. Another object of the present invention is to provide a ball return apparatus for exercising abdominal muscles that utilizes a bi-sectional base platform with a pivoting backrest wherein the two sections are connected by an adjustable tension spring to provide the user with lift on the upswing and cushioning on the downswing.

Yet another object of the present invention is to provide a ball return apparatus for exercising abdominal muscles that includes deflection nets that are height adjustable to provide for different levels of intensity for the workout.

Still yet another object of the present invention is to provide a ball return apparatus for exercising abdominal muscles that includes three deflection nets wherein the two outer nets can be adjusted to different angles to provide a workout for abdominal oblique muscles.

Yet another object of the present invention is to provide a ball return apparatus for exercising abdominal muscles that includes an adjustable tension spring to stabilize the deflection net support framework.

A still further object of the present invention is to provide a ball return apparatus for exercising abdominal muscles that includes a ball that could be filled with varying amounts of air or water to adjust the weight to change the intensity of the workout.

Another further object of the present invention is to provide a ball return apparatus for exercising abdominal muscles that has releasable springs at critical pivot points and telescoping support members that allow for folding into a compact unit for easy transport and storage.

Additional objects of the present invention will appear as the description proceeds.

The present invention overcomes the shortcomings of the prior art by providing a ball return apparatus for exercising abdominal muscles that incorporates skill and fun into a workout. As the user does sit-ups he is also throwing a ball at the deflection net on the way up and catching it on the way down thereby working on timing and coordination at the same time as toning.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention. and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which.

LIST OF REFERENCE NUMERALS

Figure 1:
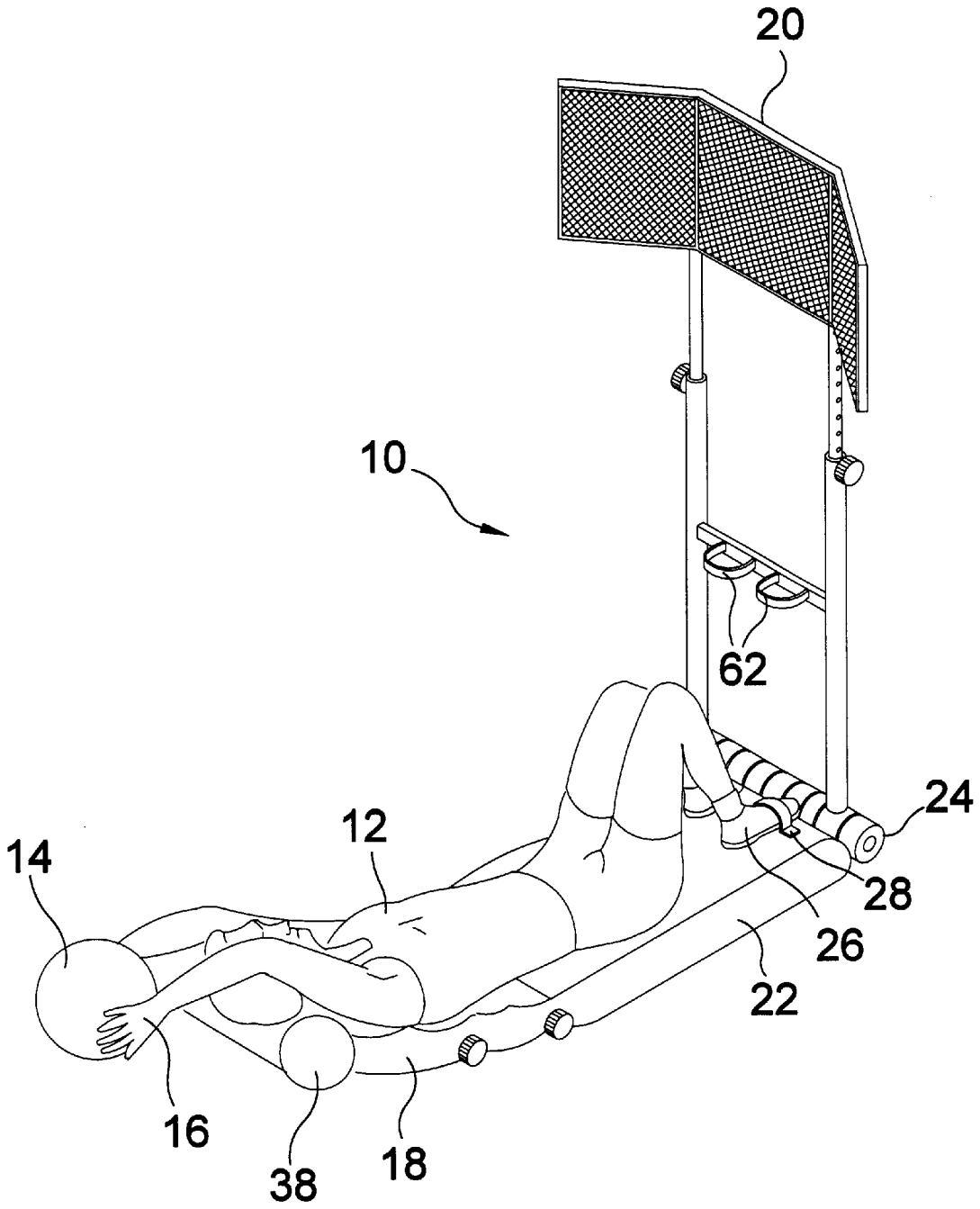
FIG. 1 is an illustrated perspective view of the present invention in use. Shown is the user with a ball in his hand and ready to sit-up with assistance from the pivoting bi-sectional spring-loaded base platform that helps propel the user from a reclined position to a sitting position as he throws the weighted ball towards an elevated ball deflection net that is connected to the stationary portion of the base platform by means of a releasable high-tension mechanical stabilizing spring.

With regard to reference numerals used, the following numbering is used throughout the drawings.

10 present invention
12 user
14 ball
16 hand
18 spring-loaded base platform
20 net
22 stationary base platform
24 spring
26 feet
28 foot straps
30 buttocks
32 back
34 head
36 spring
38 headrest
40 left net
42 right net
44 direction arrows
46 pivot means
48 inner support members
50 outer support members
52 locking means
54 inner ball chamber
56 outer ball chamber
58 water
60 valve stem means
62 foot straps
64 height adjustment means
66 cross member

DESCRIPTION OF THE PREFERRED EMBODIMENT(S)

In order that the invention may be more fully understood, it will now be described. by way of example, with reference to the accompanying drawings in which FIGS. 1 through 10 illustrate the present invention being a device for exercising abdominal muscles.

Turning to FIG. 1, shown therein is an illustrated perspective view of the present invention 10 in use. Shown is the user 12 with a ball 14 in his hand 16 and ready to sit-up with assistance from the pivoting bi-sectional spring-loaded base platform 18 that helps propel the user 12 from a reclined position to a sitting position as the user throws the weighted ball 14 towards an elevated ball central deflection net 20 that is connected to the foot end of the stationary portion of the base platform 22 by means of a releasable high-tension mechanical stabilizing spring 24. The feet 26 of the user are secured by a pair of foot straps 28. Another pair of foot straps 62 are shown along with headrest 38.

Figure 2:
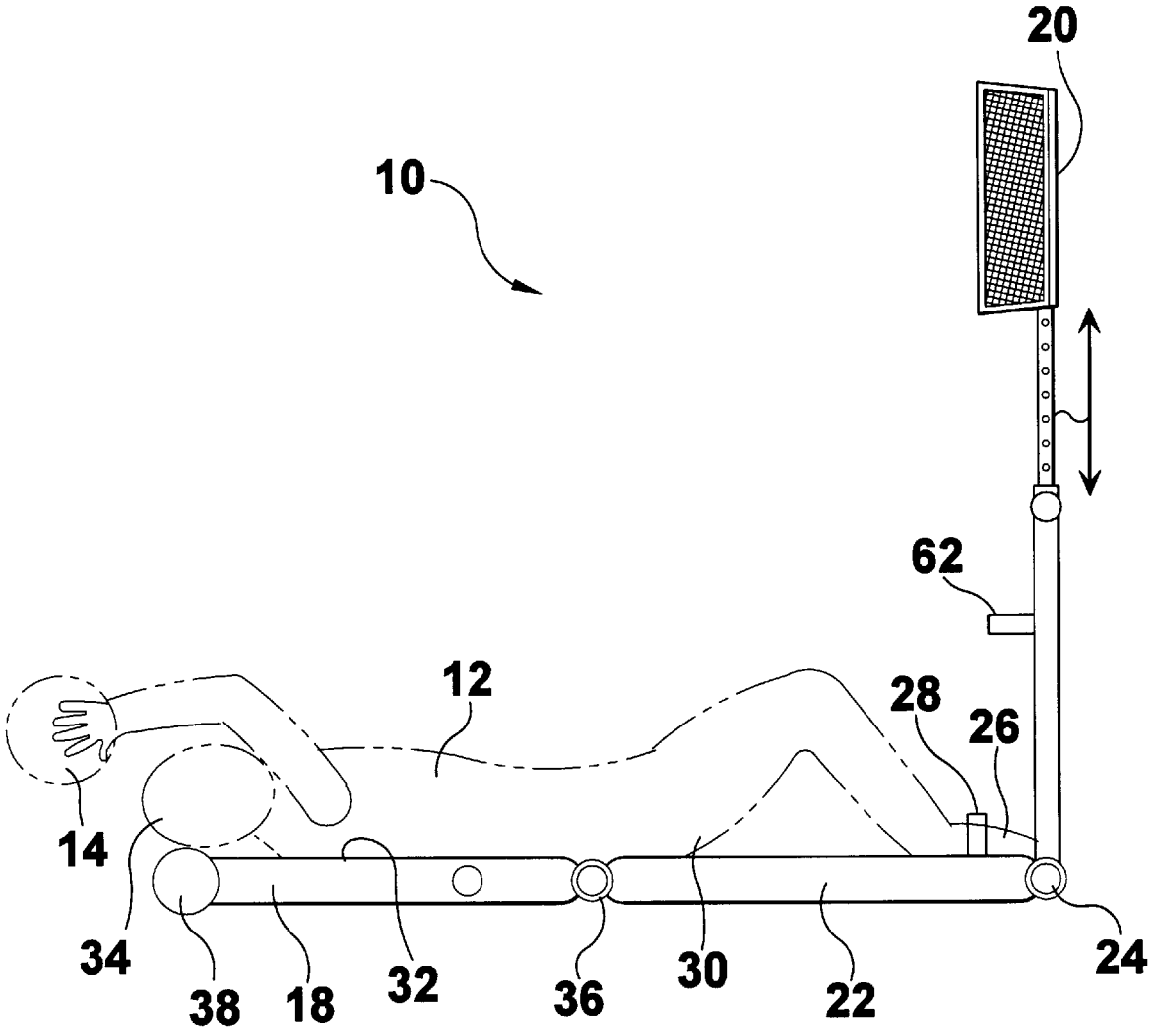
FIG. 2 is a side view of the present invention in use as shown in FIG. 1. The user is shown in phantom line with the pivoting backrest all the way down against the floor in the start position the user to lay on his back upon the base platform with his feet secured within foot straps located in the proximity of the deflection net. The user's feet and buttocks reside on the stationary portion of the base platform while his back and head are supported by the pivoting backrest which is at approximately a 45 degree angle to the floor and stationary portion when inert. The user begins the exercise by holding a ball and leaning back against the pivoting backrest to provide tension on the spring mechanism so he is propelled forward when he begins the sit-up. As the user is moving upward he throws the ball towards one of the deflection nets

Turning to FIG. 2, shown therein is a side view of the present invention 10 in use as shown in FIG. 1. The user 12 is shown in phantom line with the pivoting generally planar backrest 18 all the wave down against the floor in the start position wherein the user lays on his back upon the upper surface of the base platform 18 with his feet 26 secured within foot straps 28 located in the proximity of the base of the center deflection net 20 near the foot end of platform 22. The user's feet 26 and buttocks 30 reside on the upper surface of the stationary portion of the generally planar base platform 22 while his back 32 and head 34 are supported by the pivoting backrest 18 which is at approximately a 45 degree angle to the floor and stationary portion when in the original, untensioned position. A releasable. adjustable high-tension mechanical stabilizing spring 36 is provided for joining platforms 18 and 22. The user 12 begins the exercise by holding a ball 14 and leaning back against the pivoting backrest 18 to provide tension on the spring mechanism 36 so he is propelled forward when he begins the sit-up. As the user 12 is moving upward he throws the ball 14 towards one of the deflection nets 20. Foot straps 62 are also shown.

Figure 3:
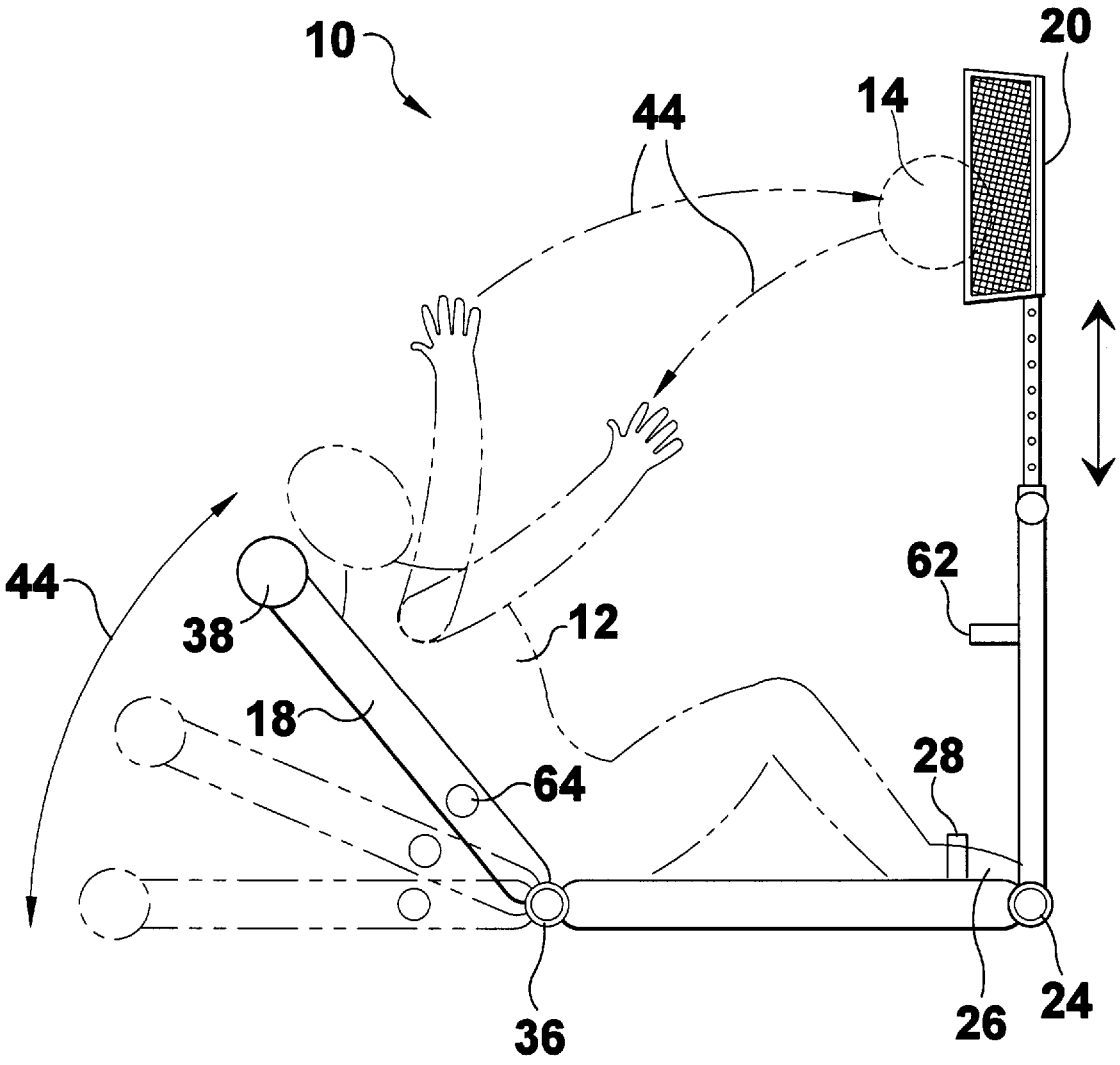
FIG. 3 is a side view of the present invention in use. Shown is the movement of the apparatus, the user and the ball during operation. The user begins the exercise by holding a ball and leaning back against the pivoting backrest to provide tension on the spring mechanism so he is propelled forward when he begins the sit-up. As the user is moving upward he throws the ball towards one of the deflection nets depending on which abdominal muscle group is selected to be worked. The user tries to time the throw so that the rebounding ball could be caught as he is heading back down to the reclined position where the tension spring provides resistance to dissipate impact and then reverses momentum to provide upward impetus for the next throw.

Turning to FIG. 3. shown therein is a side view of the present invention 10 in use. Shown with direction arrow-s 44 is the movement of the apparatus 10, the user 12 and the ball 14 during operation. The user 12 begins the exercise by holding a ball 14 and leaning back against the pivoting backrest 18 to provide tension on the spring mechanism 36 so he is propelled forward when he begins the sit-up. As the user 12 is moving upward he throws the ball 14 towards one of the deflection nets 20 depending on which abdominal muscle group is selected to be worked. The user 12 tries to time the throw so that the rebounding ball 14 could be caught as the user is heading back down to the reclined position where the tension spring 36 provides resistance to dissipate impact and then reverses momentum to provide upward impetus for the next throw. Also shown is height adjustment means 64 for the pivotal backrest 18. Other elements are also shown as previously disclosed.

Figure 4:
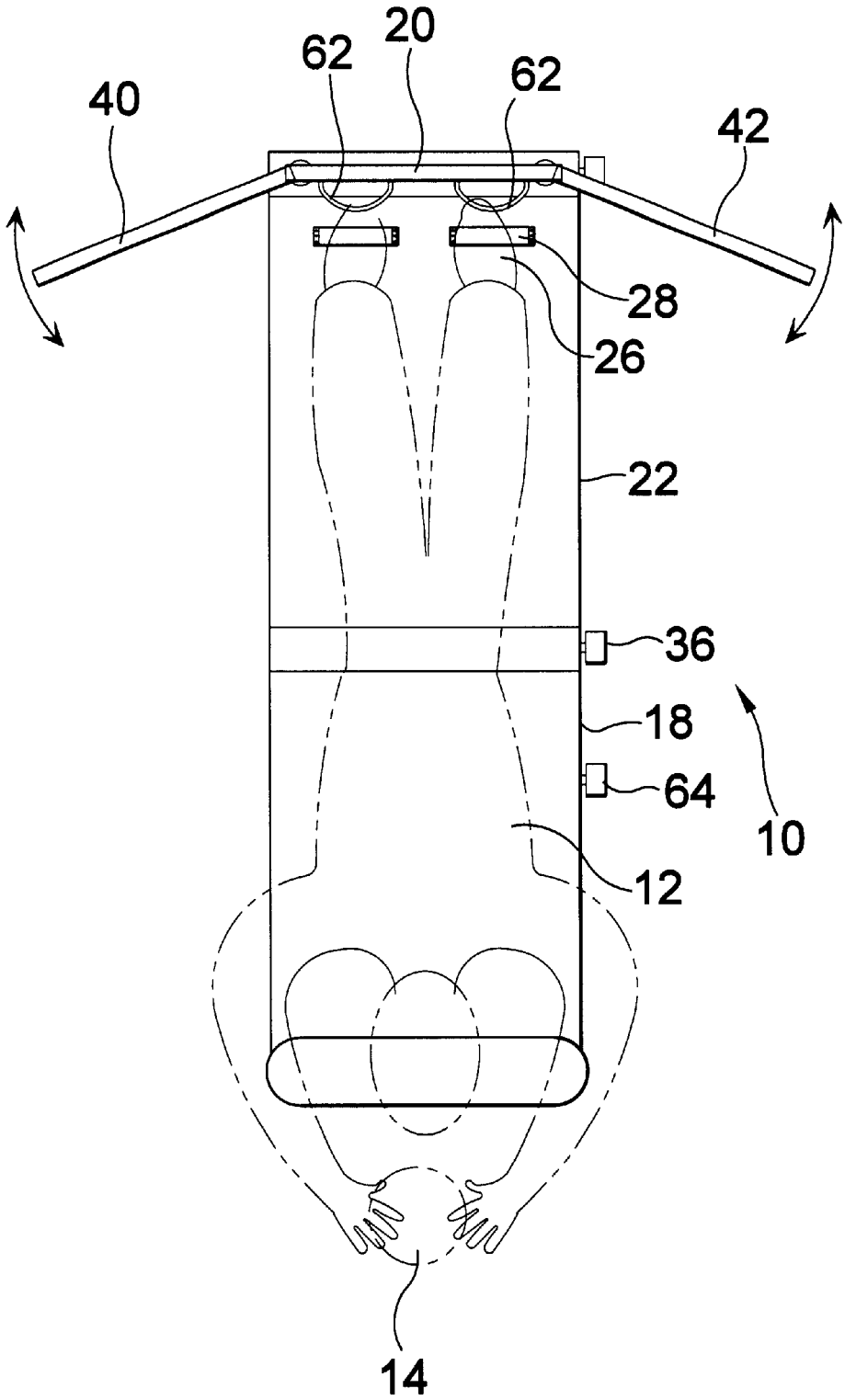
FIG. 4 is a top view of the present invention in use. Shown is the angle of the left and right deflection nets which are used when the user wishes to work on the oblique abdominal muscle group. The user, shown in phantom line, has placed his feet in the foot straps and is ready to begin exercising.

Turning to FIG. 4, shown therein is a top view of the present invention 10 in use. Shown is the angle of the left 40 and right 42 deflection nets which are used when the user wishes to work on the oblique abdominal muscle group. The user 12, shown in phantom line, has placed his feet 26 in the foot straps 38 and is ready to begin exercising. Other elements are shown as previously disclosed.

Figure 5:
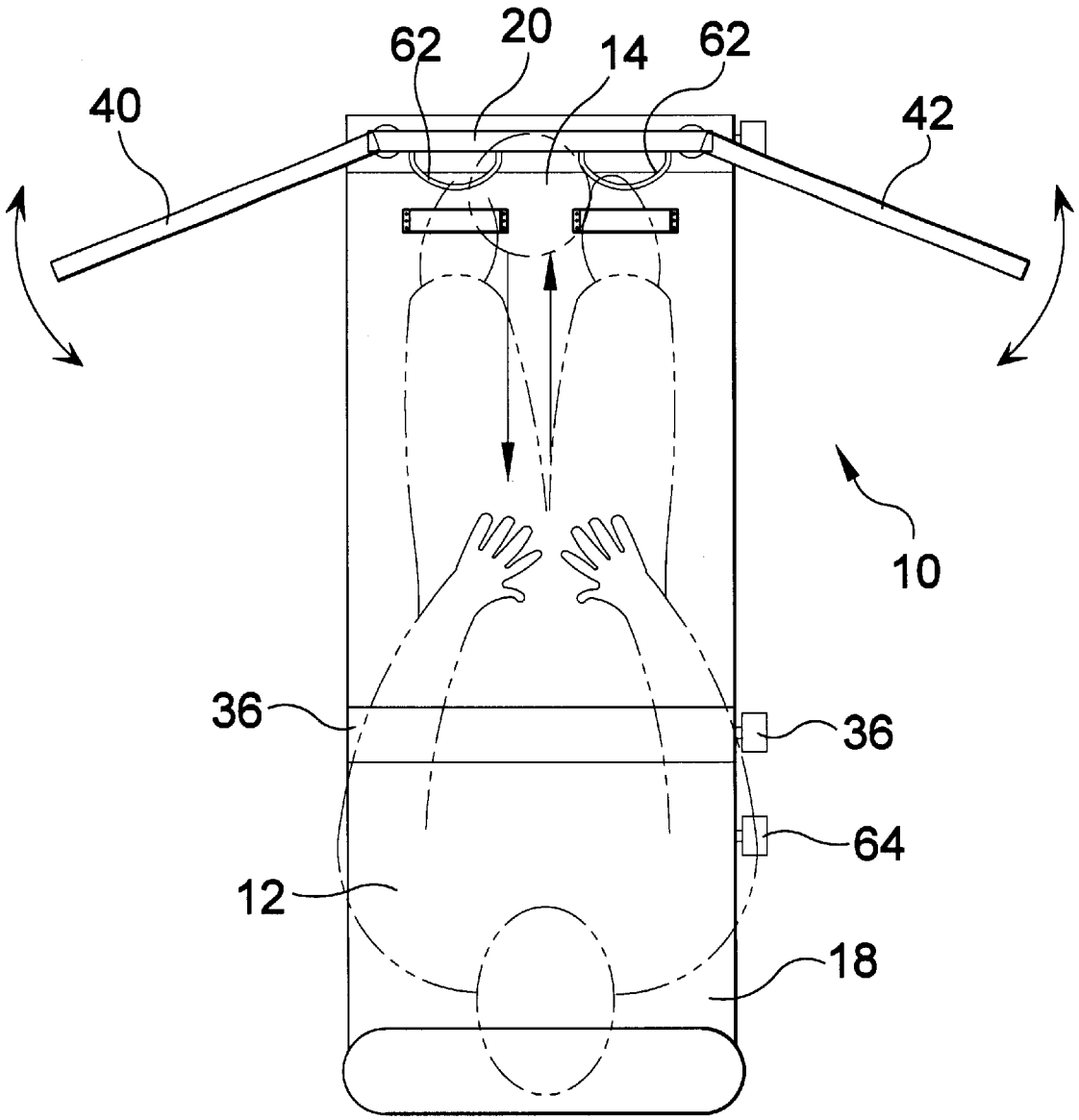
FIG. 5 is a top view of the present invention in use. The user begins the exercise by holding a ball and leaning back against the pivoting backrest to provide tension on the spring mechanism so he is propelled forward when he begins the sit-up. As the user is moving upward he throws the ball towards one of the deflection nets depending on which abdominal muscle group is selected to be worked. The user tries to time the throw so that the rebounding ball could be caught as he is heading back down to the reclined position where the tension spring provides resistance to dissipate impact and then reverses momentum to provide upward impetus for the next throw.

Turning to FIG. 5, shown therein is a top view of the present invention 10 in use. The user 12 begins the exercise by holding a ball 14 and leaning back against the pivoting backrest 18 to provide tension on the spring mechanism 36 so he is propelled forward when he begins the sit-up. As the user 12 is moving upward he throws the ball 14 towards one of the deflection nets 20, 40, 42 depending on which abdominal muscle group is selected to be worked. The user 12 tries to time the throw so that the rebounding ball 14 could be caught as he is heading back down to the reclined position where the tension spring 36 provides resistance to dissipate impact and then reverses momentum to provide upward impetus for the next throw. Other elements are shown as previously disclosed.

Figure 6:
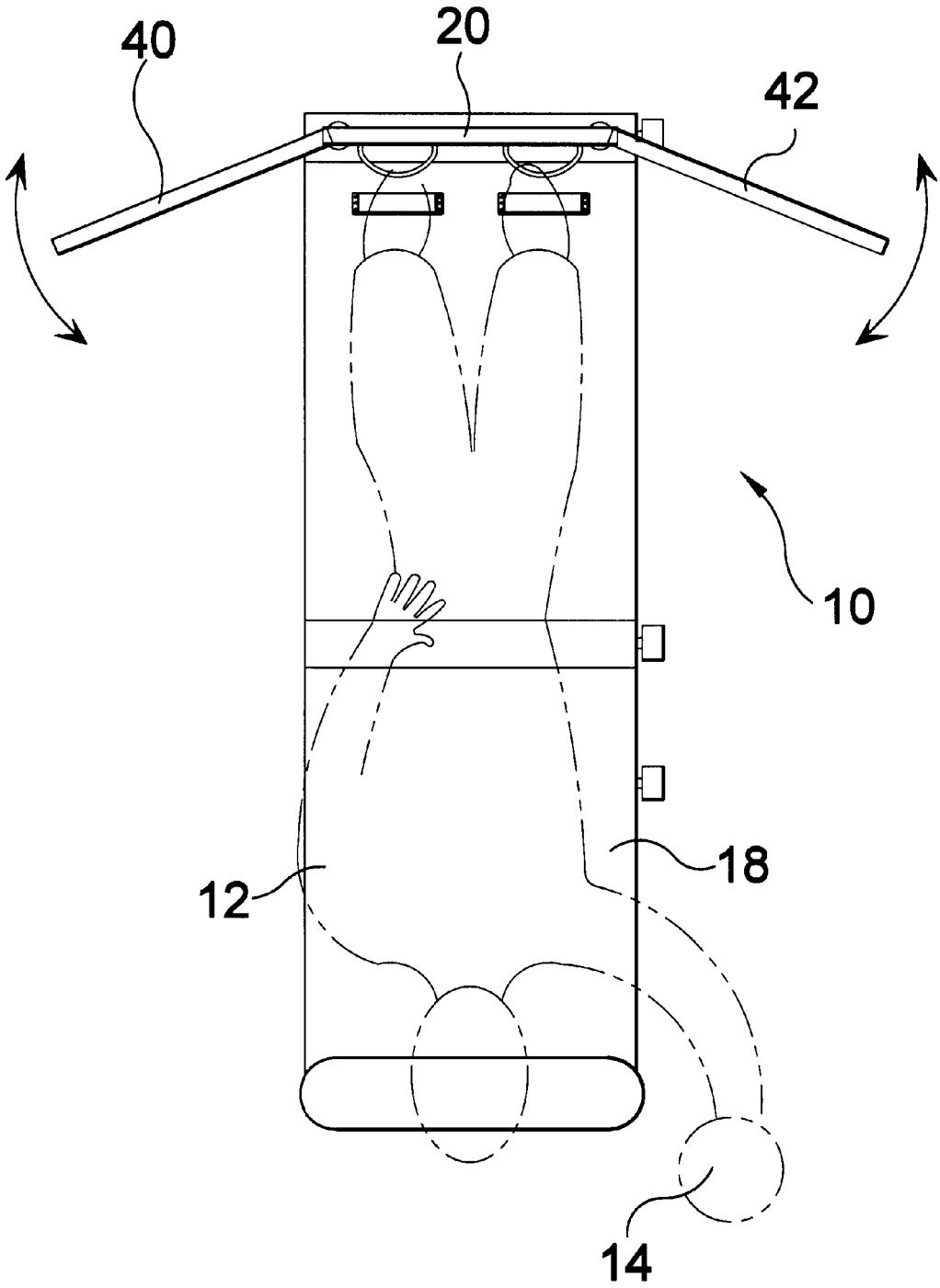
FIG. 6 is a top view of the present invention in use. Shown is the user in the down position and ready to work on his oblique abdominal muscles. He has the ball in his right hand and is ready to throw it into the left deflection net thereby working his obliques as he twists sideways.

Turning to FIG. 6, shown therein is a top view of the present invention 10 in use. Shown is the user 12 in the down position and ready to work on his oblique abdominal muscles. He has the ball 14 in his right hand and is ready to throw the ball into the left 40 deflection net thereby working his obliques as he twists sideways. Other elements are shown as previously disclosed.

Figure 7:
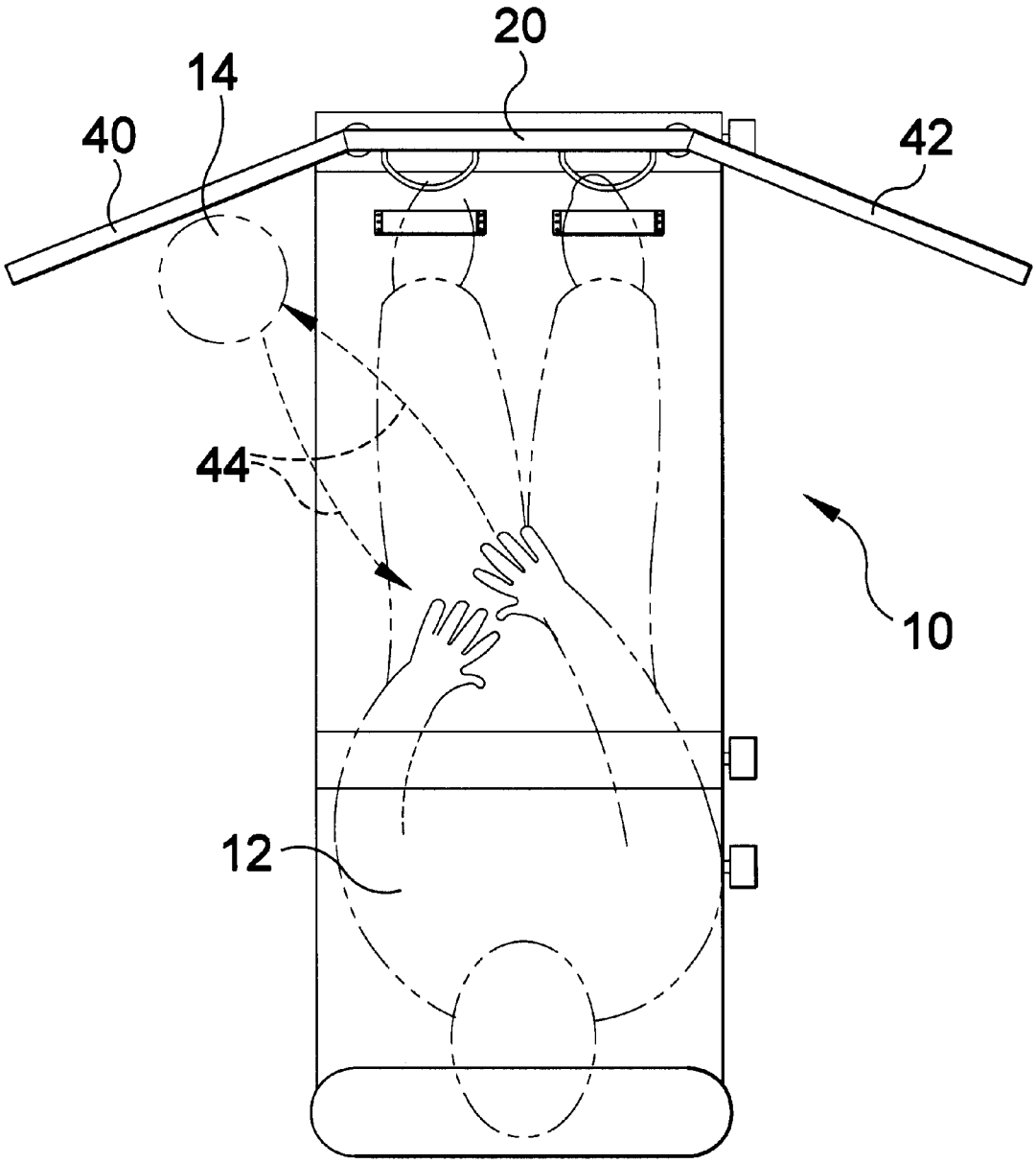
FIG. 7 is a top view of the present invention in use. Shown is the user throwing and receiving the ball as he goes through the range of motion while working his oblique abdominal muscles. The antagonistic oblique abdominal muscles could be worked out by switching hands and throwing the ball into the net on the opposite side.

Turning to FIG. 7, shown therein is a top view of the present invention 10 in use. Shown is the user 12 throwing and receiving the ball 14 as shown by direction arrows 44 as he goes through the range of motion while working his oblique abdominal muscles. The antagonistic oblique abdominal muscles could be worked out by switching hands and throwing the ball into the net on the opposite side. Other elements are shown as previously disclosed.

Figure 8:
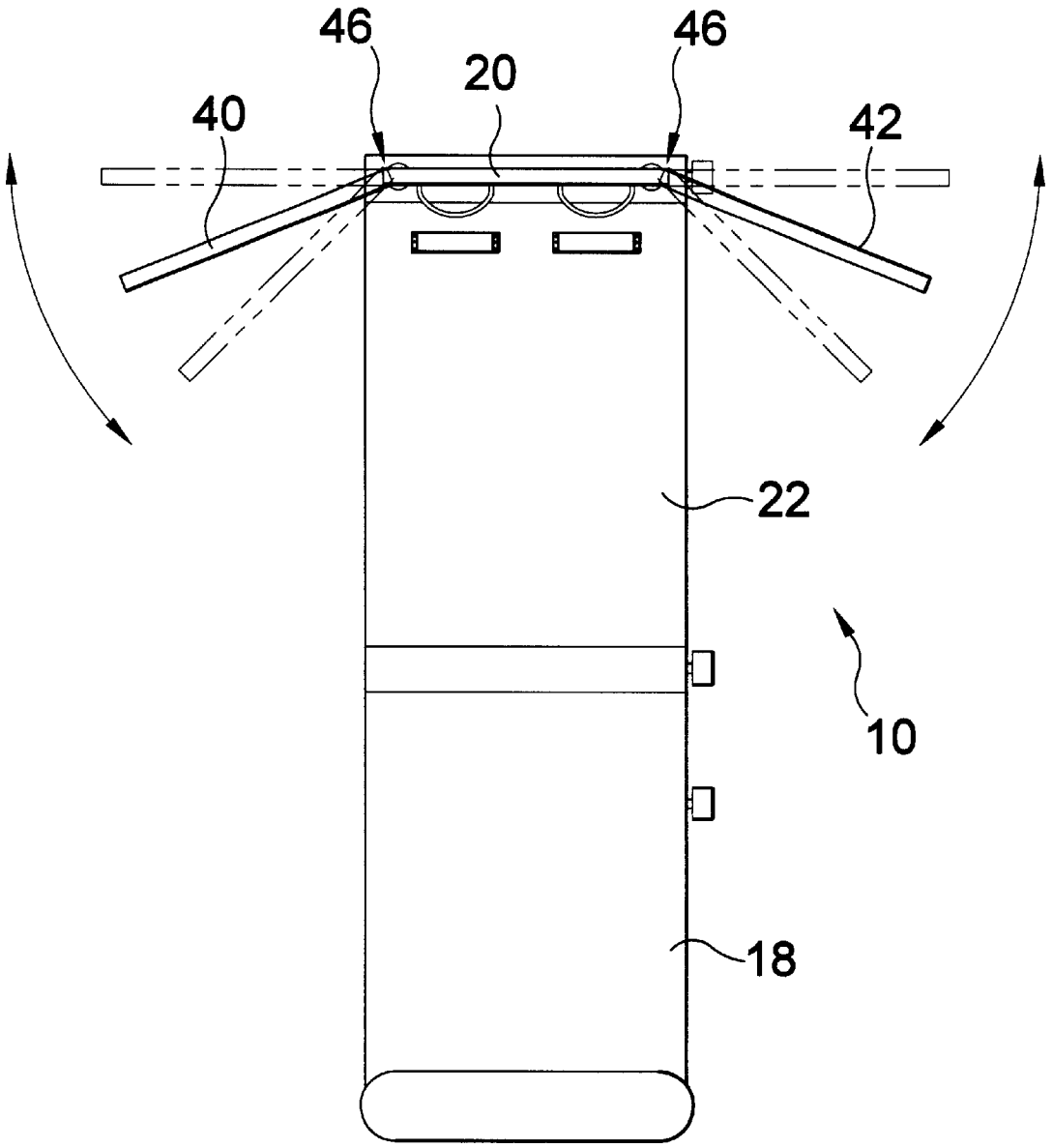
FIG. 8 is a top view of the present invention showing the maneuverability of the outer deflection nets. The outer deflection nets which are used to work the oblique abdominal muscles can be adjusted to various angles according to the users needs. Furthermore, the outer deflection nets can be folded flat against the center deflection net to provide for compact storage when not in use.

Turning to FIG. 8, shown therein is a top view of the present invention 10 showing the maneuverability of the outer deflection nets 40, 42. The outer deflection nets 40, 42 which are used to work the oblique abdominal muscles can be adjusted to various angles according to the users needs. Furthermore, the outer deflection nets 40, 42 having pivot means 46 can be folded flat against the center deflection net 20 to provide for compact storage when not in use. Other elements are shown as previously disclosed.

Figure 9:
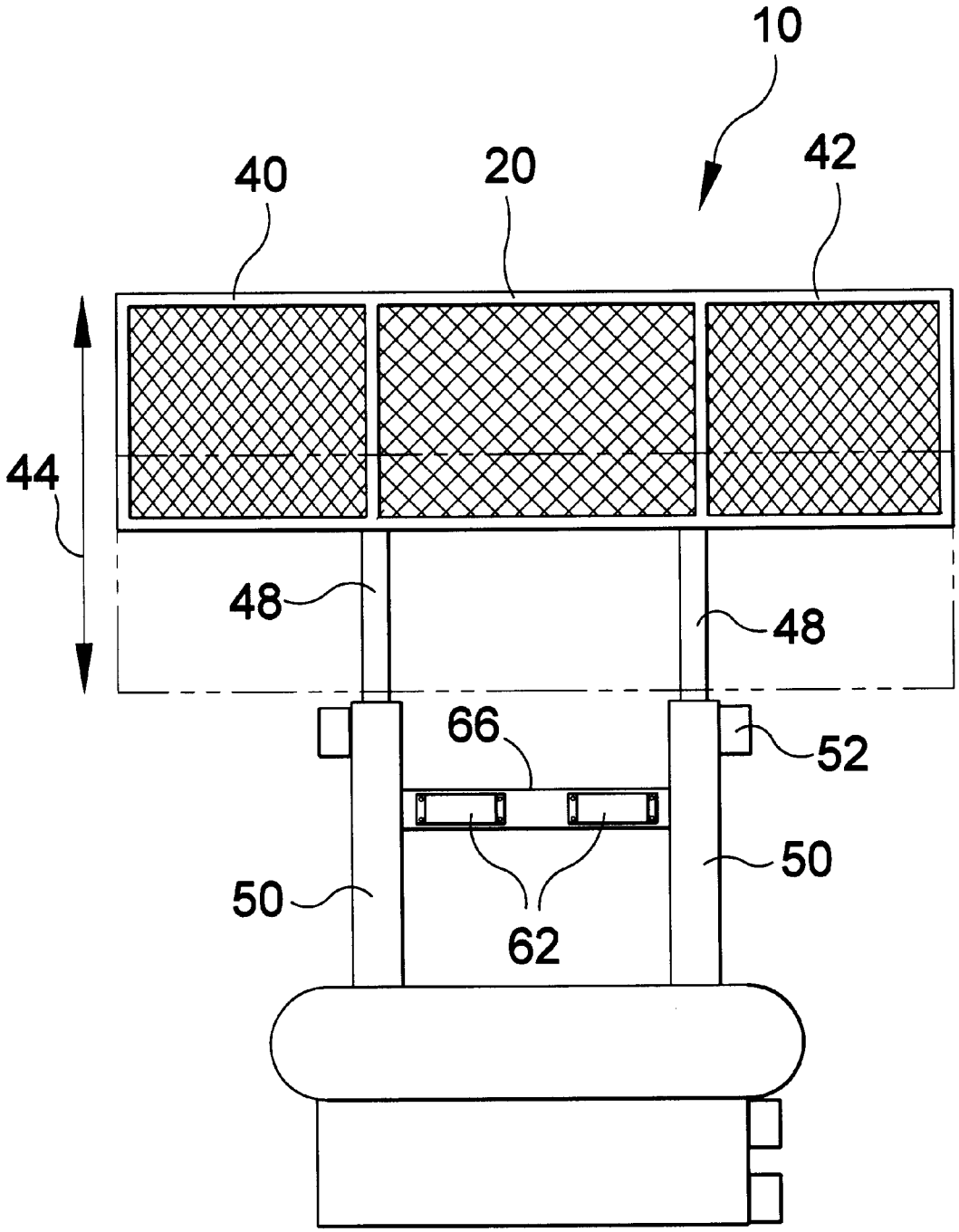
FIG. 9 is a front projection of the present invention illustrating the height adjustment capabilities of the deflection nets through the use of telescoping support members. The telescoping feature also provides for compact storage of the present invention when not in use.

Turning to FIG. 9, shown therein is a front projection of the present invention 10 illustrating with arrows 44 the height adjustment capabilities of the deflection nets 20, 40, 42 through the use of a pair of telescoping cylindrical tube support members having an inner member 48 and an outer member 50 having mating apertures to receive a lockout or pin 52. The telescoping feature also provides for compact storage of the present invention 10 when not in use. Locking means 52 are also shown for securing inner member 48 in a selected position within outer member 50. A cross member 66 is also provided between and connected to supports 50 having a pair of foot straps 62 thereon.

Figure 10:
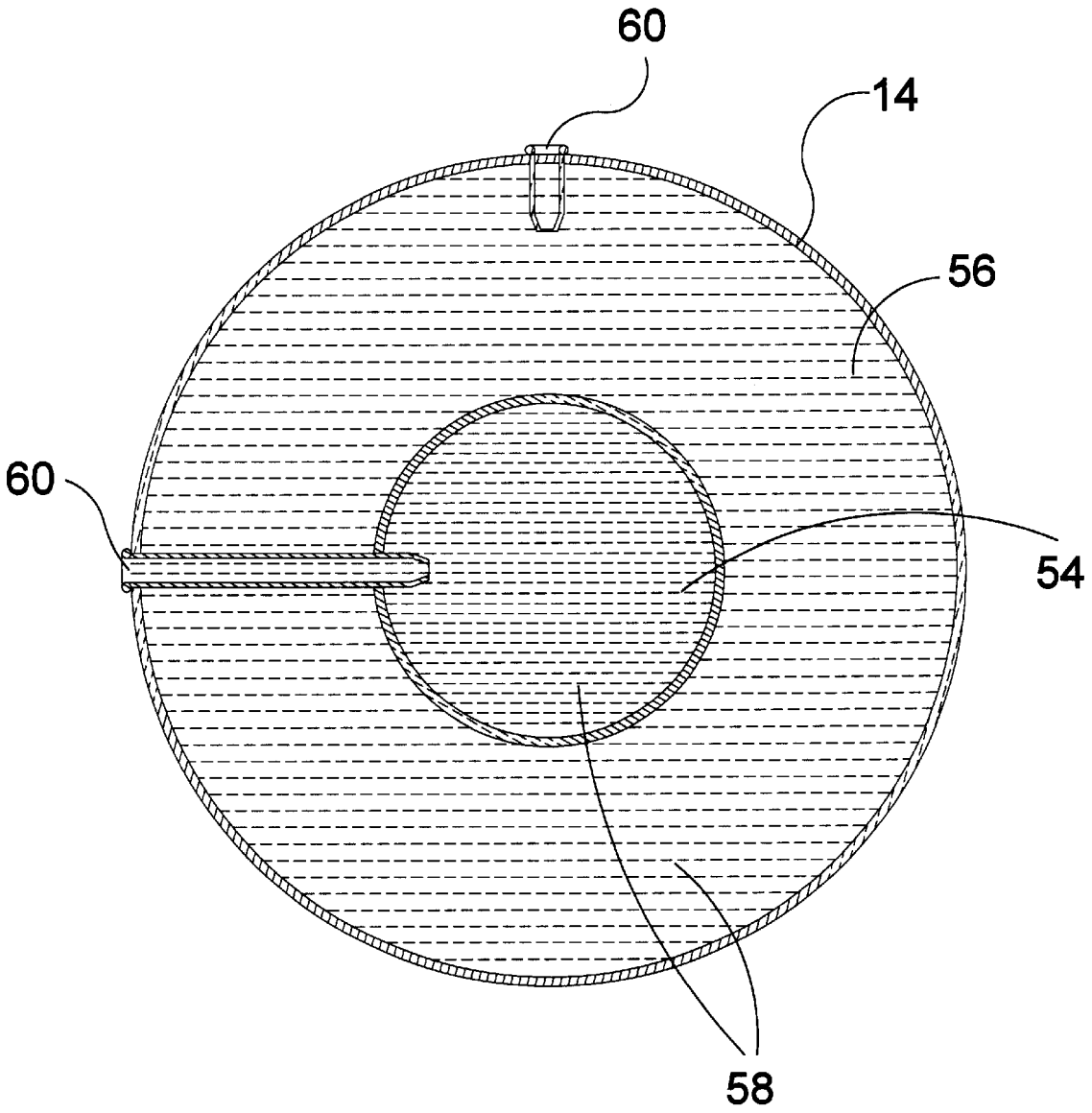
FIG. 10 is a cross-sectional view of the medicine ball for the present invention. It comprises two chambers which could be filled with either water or air depending upon the weight of the ball desired by the user. In this view both the inner and outer chambers are filled with water thereby providing maximum weight and resistance.

Turning to FIG. 10, shown therein is a cross-sectional view of the medicine ball 14 for the present invention. It comprises an inner 54 and outer 56 chambers having valve stem means 60 which could be filled with either water or air depending upon the weight of the ball desired by the user. In this view both the inner 54 and outer 56 chambers are filled with water 58 thereby providing maximum weight and resistance.

I claim:

1. An exercise apparatus for a human user for operation upon a supporting foundation, comprising:

a) a platform upon which the user lies said platform being generally planar having an upper surface upon which the user lies and a lower surface which rests on the supporting foundation;

b) said platform having a first pivotable portion and a second stationary portion, said second stationary portion having a foot end;

c) a pivot means connecting said first pivotable portion to said second stationary portion;

d) said pivot means having a spring loaded means providing lift to said first pivotable portion;

e) a rebound net;

f) means for connecting said rebound net to said second stationary portion of said platform; and, g) a ball for use by the user.

2. The apparatus of claim 1, said platform further comprising cushioning.

3. The apparatus of claim 1, said pivotable portion of said platform further comprising a headrest for the user.

4. The apparatus of claim 1, said pivot means disposed between said first pivotable portion and said second stationary portion.

5. The apparatus of claim 4, wherein said first pivotable portion and said second stationary portion are substantially of equal length.

6. The apparatus of claim 1, said spring-loaded means further comprising a releasably adjustable tensioning means.

7. The apparatus of claim 1, said first pivotable portion of said platform further comprising a height adjustment means whereby the length of said first pivotable portion is varied.

8. The apparatus of claim 1, said spring-loaded means being untensioned when said first pivotable portion is at about a 45 degree angle with the supporting foundation.

9. The apparatus of claim 1, said rebound net having a first central portion, a second left portion and a third right portion.

10. The apparatus of claim 9, said second portion and said third portion attached by pivot means to said first portion.

11. The apparatus of claim 10, said second portion and said third portion having a pivot means whereby said second portion and said third portion are foldable against said first portion.

12. The apparatus of claim 1, said means for connecting further comprising a pair of upright telescoping members, said telescoping member having height adjustment means.

13. The apparatus of claim 12, said telescoping members further comprising a pair of members each having an inner member and an outer member having, apertures therein, said apertures being mating apertures for receiving a locking means whereby said inner member is secured within said outer member.

14. The apparatus of claim 13, further comprising a releasably adjustable spring member for connecting said telescoping members to said foot of said second stationary platform.

15. The apparatus of claim 14, said spring member further comprises a releasably adjustable tensioning means.

16. The apparatus of claim 1, further comprising a first pair of foot straps disposed near the foot end of said upper surface of said stationary portion of said platform.

17. The apparatus of claim 12, further comprising a horizontal cross member connecting said upright telescoping members, said cross member having a second pair of foot straps disposed thereon.

18. The apparatus of claim 1, said ball further comprising an inner chamber and an outer chamber. said inner chamber having a first inlet means, and said outer chamber having a second inlet means.

19. The apparatus of claim 18, wherein said inner chamber and said outer chamber contain water.

20. The apparatus of claim 18, wherein said inner chamber and said outer chamber contain air.

* * * * *